US010889471B2

(12) United States Patent
Novacek

(10) Patent No.: US 10,889,471 B2
(45) Date of Patent: Jan. 12, 2021

(54) ESCALATOR WHICH CAN BE CONNECTED TO A LIFT

(71) Applicant: INVENTIO AG, Hergiswil (CH)

(72) Inventor: Thomas Novacek, Schwechat (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 16/759,700

(22) PCT Filed: Oct. 5, 2018

(86) PCT No.: PCT/EP2018/077178

§ 371 (c)(1),
(2) Date: Apr. 27, 2020

(87) PCT Pub. No.: WO2019/086203

PCT Pub. Date: May 9, 2019

(65) Prior Publication Data

US 2020/0299106 A1 Sep. 24, 2020

(30) Foreign Application Priority Data

Oct. 30, 2017 (EP) ..... 17199216

(51) Int. Cl.
*B66B 31/00* (2006.01)
*B66B 23/12* (2006.01)
*B66B 20/00* (2006.01)

(52) U.S. Cl.
CPC ..... *B66B 31/006* (2013.01); *B66B 23/12* (2013.01)

(58) Field of Classification Search
CPC ..... B66B 20/00; B66B 23/12; B66B 31/00; B66B 31/006
USPC ..... 198/321, 866; 187/245
See application file for complete search history.

(56) References Cited

U.S. PATENT DOCUMENTS 1,993,309 A * 3/1935 Rubin ..... B66B 9/083 187/201
3,033,340 A * 5/1962 Coryell ..... B66B 21/04 198/315
4,499,973 A * 2/1985 De Lorenzi ..... B66B 1/20 187/385
4,557,369 A * 12/1985 Ishida ..... B66B 23/12 198/333
4,681,207 A 7/1987 Moto et al.
(Continued)

FOREIGN PATENT DOCUMENTS

CN 102701061 A 10/2012
DE 3443425 A1 5/1986
GB 2169575 A 7/1986

OTHER PUBLICATIONS

US 2005/0217939 A1, Nielsen et al., Oct. 6, 2005.*
International Search Report for International Application No. PCT/EP2018/077178 dated Jan. 22, 2019.

*Primary Examiner* — Douglas A Hess
(74) *Attorney, Agent, or Firm* — Knobbe Martens Olson & Bear LLP

(57) ABSTRACT

This application relates to an escalator which comprises a structural frame, said escalator being connectible to a lift or elevator. For this purpose, fastening points for fastening components of the lift or elevator are arranged on the structural frame so that at least some of the components of the lift or elevator can be supported by means of the structural frame.

18 Claims, 3 Drawing Sheets

(56) References Cited

U.S. PATENT DOCUMENTS

| | | | | |
|---|---|---|---|---|
| 4,682,681 | A * | 7/1987 | Teranishi | B66B 31/006 198/324 |
| 5,062,519 | A * | 11/1991 | Haruta | B66B 31/006 198/333 |
| 5,125,481 | A * | 6/1992 | Shibata | B66B 9/00 187/245 |
| 5,381,881 | A * | 1/1995 | Meyer | B66B 31/006 198/333 |
| 5,386,904 | A | 2/1995 | Ojima et al. | |
| 7,980,379 | B2 | 7/2011 | Winkler | |
| 8,028,807 | B2 * | 10/2011 | Deplazes | B66B 5/0025 187/391 |
| 8,146,713 | B2 * | 4/2012 | Rosenthal | B66B 9/083 187/245 |
| 8,328,003 | B2 * | 12/2012 | Webster | B66B 31/006 198/732 |
| 10,414,632 | B1 * | 9/2019 | Terry | B66B 23/02 |
| 2011/0147164 | A1 | 6/2011 | Webster et al. | |

* cited by examiner

ESCALATOR WHICH CAN BE CONNECTED TO A LIFT

INCORPORATION BY REFERENCE OF ANY PRIORITY APPLICATIONS

Any and all applications for which a foreign or domestic priority claim is identified in the Application Data Sheet as filed with the present application are hereby incorporated by reference under 37 CFR 1.57.

TECHNICAL FIELD

This application concerns an escalator, the design of which is suitable for the transport of wheelchairs, push-chairs, shopping trolleys, and similar.

SUMMARY

Many escalators still represent an obstacle for wheelchair users, and users with push-chairs, for example. These usually have to look around for elevators, which means detours and search effort for them. To solve this problem, in U.S. Pat. No. 5,386,904 A an escalator is proposed with mechanically highly complicated, height-adjustable steps, such that a platform for wheelchairs can be formed from three steps. These solutions are very expensive and harbour the risk of high levels of maintenance and damage. In particular, the wheelchair transport mode also interrupts and slows down the escalator transport flow for a certain period of time.

The object of the present application is therefore to provide an escalator that has a lower level of technical complexity, and which is nevertheless suitable for the aforementioned users.

This object is achieved by an escalator with a structural frame, wherein fastening points for the fastening of components of an elevator are arranged on the structural frame. This advantageous configuration of the structural frame makes it possible to connect the escalator to an elevator, and thus use the escalator's structural frame as a structural frame for the fitted elevator components.

The escalator has a first access zone, which is located at its point of use on a first level of a building. Furthermore, the escalator has a second access zone, which is located on a second level of the building. The escalator also has an inclined zone that connects the two access zones. Components of an elevator are located to the side of the escalator and outside its conveyor zone at the fastening points of the structural frame. The elevator that thus belongs to the escalator is arranged between the same levels as the escalator and connects these with one another. Since the escalator has an elevator in addition to the conventional step chain for the additional transport of users, the two transport options are directly combined, making it easy for users who cannot use the step chain to find the elevator. In addition, both transport options can be used simultaneously and the elevator can be used independently of the direction of the step chain, so that the transport flow of the step chain is not affected. The elevator has at least one guide rail, and a platform that can move in a guided manner on the guide rail. The platform can be used to transport objects and/or users between the two levels as required.

In one embodiment, the at least one guide rail is connected to the structural frame, at least indirectly, by way of the fastening points. This means that the at least one guide rail, as one of the components of the elevator, can be fastened directly to the fastening points, or indirectly by means of intermediate parts, such as struts, intermediate plates, covering panels, fastening brackets, and all kinds of fastening devices, arranged between the structural frame and the components of the elevator. However, no intermediate parts, within the meaning of the present invention, are parts of the building, such as walls, floors, stairs, shafts, and similar. It is therefore essential that at least one component of the elevator is at least partially supported by the structural frame of the escalator.

In one embodiment, the at least one guide rail can be arranged in the region of one of the two access zones of the escalator, at the fastening points of the structural frame, and vertically between the first level and the second level. Since at least one access zone of the elevator is almost at the same location as one of the two access zones of the escalator, it can be immediately located by users with wheelchairs, pushchairs, or means of transport such as pallet trucks or shopping trolleys. In addition, the guide rails of the elevator can be fastened at least at one of their ends to the structural frame that is provided and designed for this purpose, without any special configuration of the building.

In one embodiment, the at least one guide rail can be arranged at least in the inclined zone at the fastening points of the structural frame between the first level and the second level. In this advantageous embodiment, both access zones of the elevator are at least close to the same location as the two access zones of the escalator.

A variety of drive concepts can be deployed to move the platform along the guide rails.

In a first drive concept, provision is made for the elevator to have an elevator drive that comprises at least one drive motor, a transmission gear, and drive wheels. The drive wheels are operatively connected to the drive motor by way of the transmission gear. To move the platform along the guide rails, the drive wheels operate directly on the guide rails, or on a drive element arranged parallel to the guide rail, such as a rack. The escalator also comprises an escalator drive, which is operatively connected to a circumferential movably arranged step chain of the escalator.

In a second drive concept, provision is made for the elevator to include at least one suspension means or device, and an elevator drive, wherein the elevator drive has a traction sheave and a drive motor. The suspension device is guided over the traction sheave of the elevator drive and connected with one of its two ends to the platform. With its other end, the suspension device can be connected to a counterweight that can move in a guided manner. This counterweight enables a mass balance of the platform, and leads in particular to a reduced absorption of energy during operation. However, it is also conceivable, that the suspension device is connected to the traction sheave at the other end and is wound onto the traction sheave in the manner of a cable drum. As in the case of the first drive concept, the escalator comprises an escalator drive, independent of the elevator drive, which is operatively connected to a circumferential movably arranged step chain of the escalator.

In a third drive concept, provision is made for the elevator to comprise at least one suspension device and a traction sheave, over which the suspension device is guided, together with a clutch transmission. The escalator also includes an escalator drive, which is operatively connected to a circumferentially arranged step chain of the escalator. Furthermore, the traction sheave can be coupled to the escalator drive of the escalator by way of the clutch transmission. With this drive concept, the elevator can again have a counter-weight that is connected to the suspension device. As already described above, the traction sheave is designed as a pure traction sheave, or as a cable drum, depending on the configuration of the elevator, with or without a counterweight.

The escalator comprises a control device, with which the escalator drive can be controlled. The elevator can be controlled by an elevator controller that is completely independent of the escalator controller. The control functions for the operation of the elevator can, however, also be implemented in the escalator controller. Needless to say, safety devices for the escalator and the elevator are also fitted, which transmit their signals to the controller.

In one embodiment, the counterweight is arranged and can be moved in a guided manner in an interior space of the escalator bounded by covering panels. As a result, it is better protected against environmental influences and the accident risk for users can be minimised.

The platform can also be configured in a different manner. For example, the platform can be provided with a sidewall, surrounding it on all sides. To allow access, the sidewall has a lockable access door on at least one side of the platform. Meshes, opaque or transparent panels, and similar, can be used as the sidewalls. Such an embodiment is particularly suitable for elevators of the aforementioned type, whose platforms are guided on guide rails arranged in the inclined zone of the structural frame.

In a further embodiment, the platform can be designed as a car floor and, enclosing a car interior, can be provided with walls, a roof and at least one door. The latter embodiment is particularly suitable for elevators of the aforementioned type, whose platforms are guided on vertically arranged guide rails.

To prevent accidents with moveable components of the elevator, barriers are provided, which separate the travel zone of the platform from the environment of the escalator. Such barriers can be meshes, opaque or transparent panels, wall sections, balustrades, and similar.

The barriers can also have an access control system. This access control system comprises at least one registration device for the registration of user data, and a blocking device.

Pivoting barriers, automatic access doors, electronic door locks, and similar, can be deployed as blocking devices.

The registration device can comprise anything from a simple push-button to a non-contact detection system. With the simple button, for example, just a user command can be entered, which, if the platform is not already in the corresponding access zone, fetches it and, if the platform is in the correct position, releases the blocking device and thus provides access to the platform. Here "correct position" refers to the two positions of the platform in the access zones of the elevator in which the platform can be safely entered or left.

With a non-contact detection system, a user's authorisation can also be detected. Thus, for example, a detection system fitted with an RFID reader can be used to detect a disabled person's ID card and to authorise the use of the elevator. Similarly, the operators of the escalator can, for example, issue user cards to disabled persons, or families with small children. Web applications are also conceivable, which can be called up by way of mobile phones, and with the help of which a user command can be transmitted to the elevator controller and the access control system. In other words, access to the platform can be blocked or released by the blocking device as a function of the current operating state, and/or registered user data. The detection system can thus prevent the elevator from being used by users who could actually use the escalator.

Needless to say, an existing escalator can also be upgraded into an escalator in accordance with the invention by connecting the existing escalator to an elevator. To make this possible, fastening points for the fastening of components of the elevator must first be arranged on the existing structural frame. Structural alterations to the existing structural frame may also be necessary in the interests of stability, for example by the insertion of additional struts, plates, and similar, into the structure. Components of the elevator can then be fastened at the fastening points.

BRIEF DESCRIPTION OF THE DRAWINGS

In what follows, different embodiments are described with reference to the accompanying figures, wherein neither the figures nor the description are to be interpreted as restricting the invention.

The figures are only schematic and are not true to scale. Identical reference symbols in the various figures indicate identical features or features that operate in the same manner.

DETAILED DESCRIPTION

Figure 1:
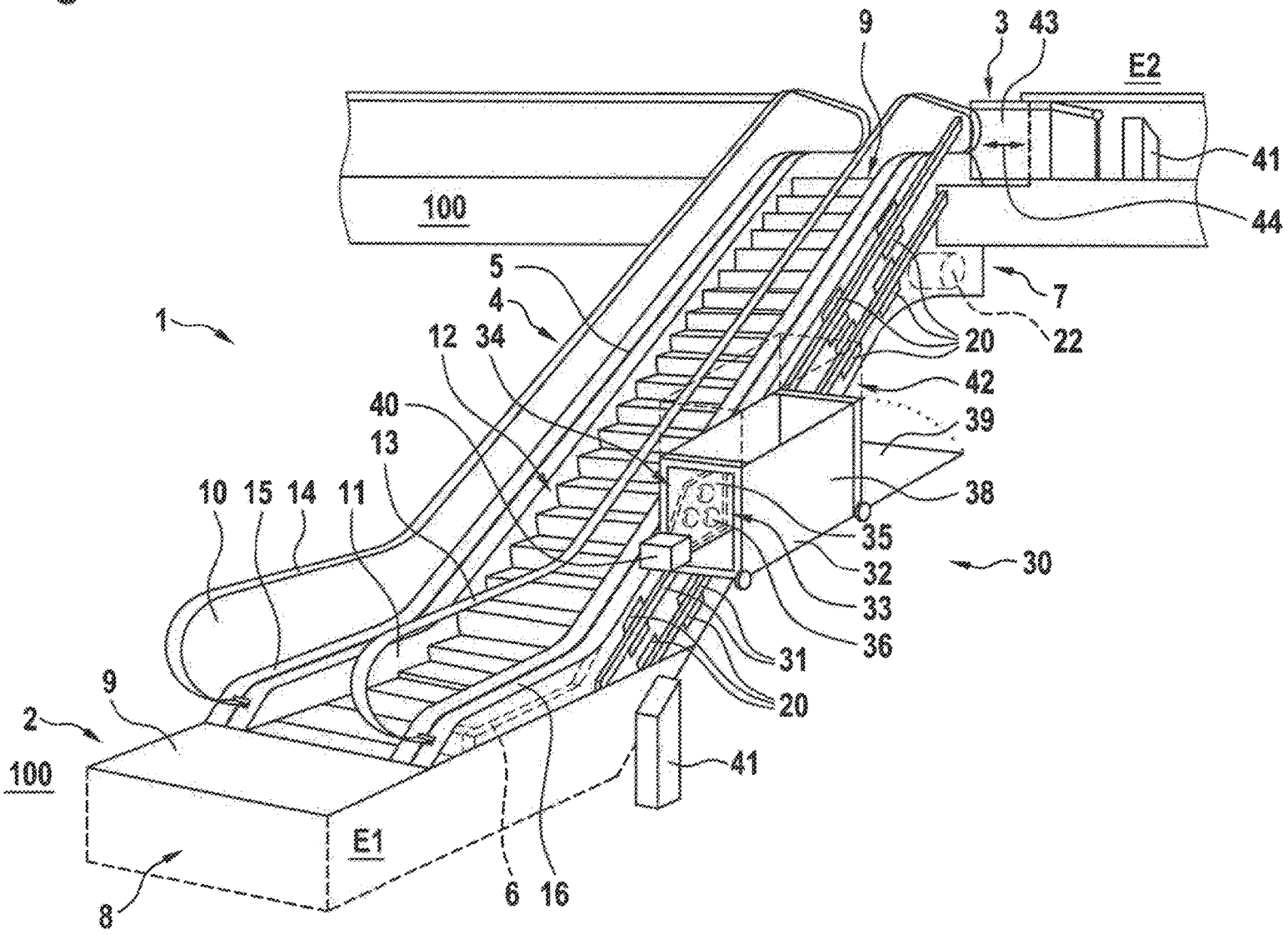
FIG. 1 shows a three-dimensional representation of an escalator with components of an elevator arranged at fastening points of the escalator structural frame in accordance with a first example of embodiment.

FIG. 1 shows a three-dimensional representation of an escalator 1, which connects a first floor E1 of a building 100 with a second floor E2. The escalator 1 has a first access zone 2, which is arranged on the first level E1 of the building 100. Furthermore, the escalator 1 has a second access zone 3, which is arranged on the second level E2 of the building 100. In addition, the escalator 1 has an inclined zone 4, which connects the two access zones 2, 3.

A conveyor zone 12 of the escalator 1 extends in its length between the two access zones 2, 3. The escalator 1 contains a structural frame 6, which in the present example of embodiment is designed as a truss (see also FIG. 2). In the structural frame 6 there are two invisible turning zones 7, 8, between which a step chain 5 is circumferentially guided. The turning zones 7, 8 of the step chain 5 are in each case hidden under a floor covering 9 of the two access zones 2, 3. Two balustrades 10, 11, each of which has a circumferential handrail 13, 14, extend on either side of the conveyor zone 12. The balustrades 10, 11 are in each case connected to the structural frame 6 at their lower end by means of a balustrade base 15, 16.

At the side of the escalator 1, and outside its conveyor zone 12, fastening points 20 are arranged for the fastening of components of an elevator 30. The fastening points 20 are formed directly on the structural frame 6 (see FIG. 2). The components of an elevator 30 include, in particular guide rails 31, a platform 32 for the accommodation of users and/or objects to be transported, and an elevator drive 33. In the present example of embodiment, two guide rails 31 are fastened at the fastening points 20, parallel to each other and vertically spaced apart, in the inclined zone 4 of the escalator 1.

The platform 32 can move in a guided manner on these guide rails 31. For safety reasons, a sidewall 38 is provided, arranged on the platform 32, and surrounding it on all sides. Needless to say, the platform 32 can also be configured as an elevator car 42, as is indicated by the broken line.

The platform 32 is moved by means of the elevator drive 33, which is integrated in the platform 32. The elevator drive 33 comprises a drive motor 34, a transmission gear 35, and drive wheels 36, wherein in the present example of embodiment these components are largely concealed by the sidewall 38. The drive wheels 36 are operatively connected to the drive motor 34 by way of the transmission gear 35. To move the platform 32 along the guide rails 31, the drive wheels 36 operate directly on the guide rails 31, or on a drive element arranged parallel to the guide rail 31, for example a rack.

In addition, the escalator 1 comprises an escalator drive 22, which is operatively connected to the circumferentially arranged step chain 5 of the escalator 1. The circumferentially arranged handrails 14 are also driven by the escalator drive 22, wherein for the sake of clarity the representation of the transmission line between the handrails 14, 15, the step chain 5, and the escalator drive 22 has been omitted.

To ensure that access to the platform 32 is only possible if the platform is in the appropriate access zones, the sidewall 38 is fitted with an access door 39. The elevator 30 is controlled by an elevator controller 40, which in the present example of embodiment is arranged on the sidewall 38 of the platform 32. If a user wants to use the platform 32, he or she can enter a user command at one of the two consoles 41, which command is passed on to the elevator controller 40. The latter controls the elevator 30 such that the platform 32 is moved to the correct access zone 2, 3, and the access door 39 provides access. The user can then enter the platform 32, wherein at least one sensor, or a further input by the user to the elevator controller 40, provides a feedback that the platform 32 is now ready to move. This now controls the elevator drive 33 so that the platform 32 travels to the other access zone 2, 3 and, once there, again releases the access door 39 to allow departure from the platform 32.

In other words, if, for example, a user command is entered at the console 41 in the access zone 2 of level E1, the platform travels to level E1. Once it reaches this level, the access door 39 opens, and the user can enter the platform 32. When the user is within the sidewall 38, the access door 39 closes and the platform 32 travels to level E2. As soon as the end position of the platform 32 on level E2 is reached, the access door 39 opens again, and the user is free to enter the level E2. To prevent anyone from falling from the level E2 to the level E1, an access barrier 43 must be provided on level E2, which only opens when the platform 32 is in the end position on level E2. The double arrow 44 indicates that the access barrier 43 can move horizontally. Needless to say, a vertically sliding access barrier 43 can also be deployed.

If required, additional information concerning the user can be requested at the console 41, so that only authorised users, such as disabled or infirm persons, persons with pushchairs or shopping trolleys, or persons with escalator anxiety, can access the platform 32.

Figure 2:
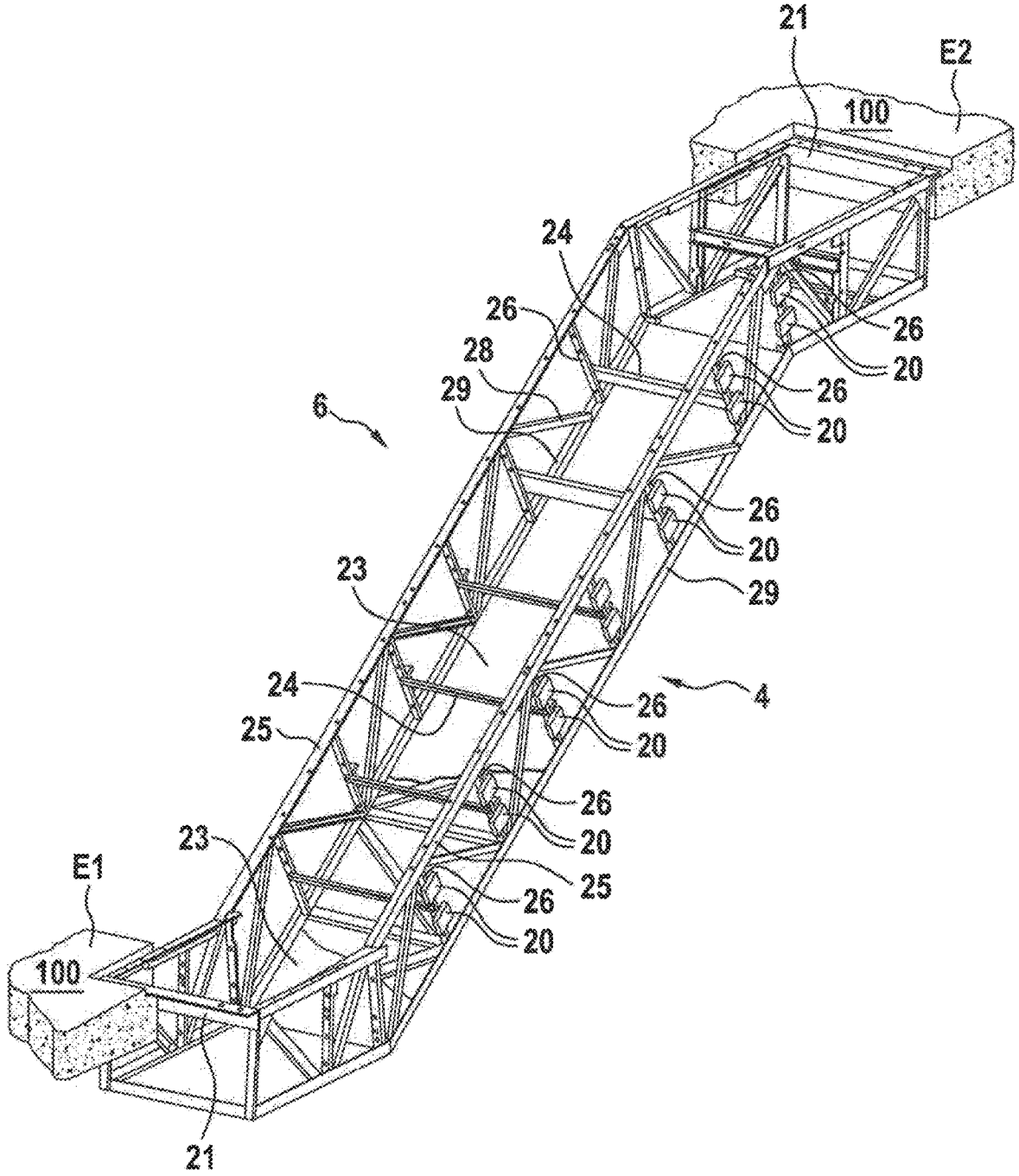
FIG. 2 shows a three-dimensional representation of the structural frame with the fastening points of the escalator represented in FIG. 1.

As already mentioned, FIG. 2 shows a three-dimensional representation of the structural frame 6 of the escalator 1 shown in FIG. 1. The structural frame 6 is embodied as a truss structure. This comprises top chords 25, bottom chords 29, diagonal braces 28 and uprights 26, which are welded together to form truss girders. The truss girders are connected to one another by means of a braced floor structure 23 and cross braces 24. On the front face, two support brackets 21 are arranged on the structural frame 6, by way of which the entire structural frame 6 is supported at one end at level E1, and at the other end at level E2, of the building 100. Correspondingly, the components of the escalator 1 and the elevator 30 (see FIG. 1), which will later be fitted in and on the structural frame 6, are also supported by way of the two support brackets 21. On one side of the structural frame 6, in the inclined zone 4, the fastening points 20 are also arranged on the uprights 26 for components of the elevator 30; specifically, for the guide rails 31 of the elevator 30.

The advantageous configuration of the structural frame 6 with fastening points 20 makes it possible to connect the escalator 1 to an elevator 30, as shown in FIG. 1, and thereby to use the structural frame 6 of the escalator 1 as a structural frame for the fitted elevator components. The elevator 30, by this means associated with the escalator 1, is located between the same levels E1, E2 of the building 100 as the escalator 1, so that the platform 32 of the elevator 30 can transport users or goods parallel to the step chain 5.

Figure 3:
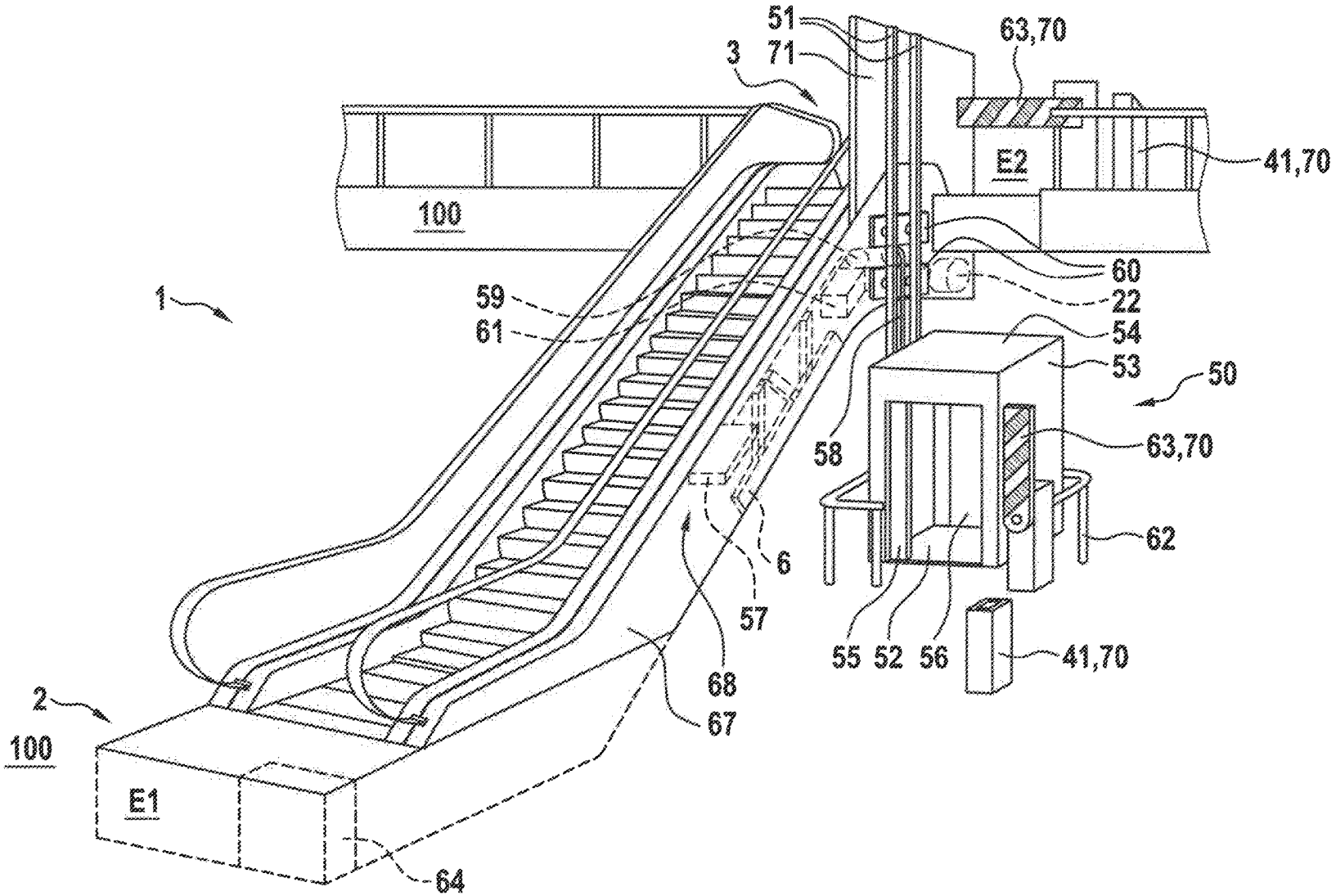
FIG. 3 shows a three-dimensional representation of an escalator with components of an elevator arranged at fastening points of the escalator structural frame in accordance with a second example of embodiment.

FIG. 3 shows a three-dimensional representation of an escalator 1 with components of an elevator 50 arranged at fastening points 60 of the escalator structural frame 6 in accordance with a second example of embodiment. As the escalator 1 is essentially identical to the escalator 1 in the first example of embodiment shown in FIG. 1, no detailed description is given of the latter. The second example of embodiment differs from the first essentially in the different configuration of the elevator 50, and its arrangement on the structural frame 6 of the escalator 1.

The elevator 50 comprises a platform 52 configured as an elevator car, which is moved in a guided manner on vertical guide rails 51. The platform 52 has car walls 53, a roof 54 and two opposing doors 55, 56.

The guide rails 51 are fastened to the fastening points 60 and extend between the two levels E1, E2 of the building 100. In the present example of embodiment, the fastening points 60 are located in the access zone 3 of the second level E2. In addition, the guide rails 51 can also be supported on, or in fact fastened to, the floor of the first level E1.

Needless to say, the guide rails 51 could also be arranged in the access zone 2 of the first level E1, and could extend vertically up to the second level E2.

The elevator 50 also has a counterweight 57, which is guided by means of counterweight rails, not shown, in an interior 68 of the escalator 1 that is bounded by covering panels 67. Between the counterweight 57 and the platform 52, which is configured as a car, is arranged a suspension means or device 58, for example a wire cable, or an elevator belt. The suspension device 58 is guided over a traction sheave 59 and is driven by the latter when the counterweight 57, the suspension device 58, and the platform 52, move. The traction sheave 59 is connected to the escalator drive 22 by way of a controllable clutch transmission 61.

To prevent persons from entering the movement zone of the platform 52, barriers 71, 62 are provided with entry gates 63. These are only examples; for example, instead of the barriers 71, 62, a shaft made of glass panels can also be provided, and instead of the entry gates 63, shaft doors can be provided in the shaft to ensure better protection. Furthermore, the barriers 71, 62 and the entry gates 63, together with the consoles 41, can form part of an access control system 70. For this purpose, the console 41 contains at least one registration device for the registration of user data, and accordingly controls the entry gates 63, which here serve as blocking devices. This enables the access to the platform 32, 52 to be blocked or released by the blocking device, depending on the user data registered.

As in the first example of embodiment in FIG. 1, two consoles 41 are also provided in the example of embodiment in FIG. 3. The consoles 41 serve to register user commands, which can be forwarded to an escalator controller 64. In the present example of embodiment, the escalator controller 64 on the one hand controls the operation of the escalator 1, and on the other hand the operation of the elevator 50, in that it also activates the controllable clutch transmission 61.

Needless to say, a variety of safety devices such as sensors, brakes, and similar, can be provided for the escalator 1 and the elevator 50 to ensure smooth and safe operation. For reasons of clarity, however, these are not shown in either FIG. 1 or FIG. 3.

Although FIGS. 1 and 3 show differently configured elevators 30, 50, the different designs can obviously be combined with one another, or modules can be exchanged. Thus, in the first example of embodiment, a counterweight and a suspension mean can also be provided. In addition, in the second example of embodiment, the elevator can comprise its own elevator drive and its own elevator controller.

Finally, it should be noted that terms such as "having," "comprising," etc. do not exclude other elements or steps, and that terms such as "one" do not exclude a multiplicity of the latter. It should furthermore be noted that features or steps described with reference to one of the above examples of embodiment can also be used in combination with other features or steps of other examples of embodiment as described above. Reference symbols in the claims are not to be regarded as a restriction.

The invention claimed is:

1. An escalator comprising:

a first access zone arranged on a first level of a building;

a second access zone arranged on a second level of the building;

an inclined zone connecting the first and second access zones with one another; and a structural frame comprising fastening points;

wherein components of an elevator can be connected to the fastening points of the structural frame such that the components of the elevator can be supported, at least partially, by the structural frame, wherein the components of the elevator are arranged at a side of the escalator that is outside a conveyor zone of the escalator, at the fastening points of the structural frame, wherein the elevator is located between the same levels as the escalator and connects these with one another, and wherein the elevator comprises at least one guide rail and a platform that is moved in a guided manner on the guide rail.

2. The escalator according to claim 1, wherein the at least one guide rail is connected to the structural frame, at least indirectly, by way of the fastening points.

3. The escalator according to claim 2, wherein:

the at least one guide rail is arranged in the zone of one of the first and second access zones at the fastening points of the structural frame, and the at least one guide rail is arranged vertically between the first level and the second level.

4. The escalator according to claim 2, wherein the at least one guide rail is arranged, at least in the inclined zone, at the fastening points of the structural frame between the first level and the second level.

5. The escalator according to claim 1, wherein:

the elevator has an elevator drive, which comprises at least one drive motor, a transmission gear, and drive wheels;

the drive wheels are operatively connected to the drive motor by way of the transmission gear; and the drive wheels operate directly on the at least one guide rail, or on a drive element arranged parallel to the guide rail, so as to move the platform along the guide rail.

6. The escalator according to claim 1, wherein the elevator has a counterweight and a suspension device, which suspension device is connected at one end to the platform, and at the other end to the counterweight.

7. The escalator according to claim 6, wherein the counterweight is arranged and can be moved in a guided manner in an interior space of the escalator bounded by covering panels.

8. The escalator according to claim 6, wherein the elevator includes an elevator drive, which has a traction sheave and a drive motor, and over whose traction sheave the suspension device is guided, and the escalator includes an escalator drive, which is operatively connected to a circumferential movably arranged step chain of the escalator.

9. The escalator according to claim 6, wherein the elevator comprises a traction sheave, over which the suspension device is guided, and a controllable clutch transmission, wherein the escalator includes an escalator drive, which is operatively connected to a circumferential movably arranged step chain of the escalator, and the traction sheave can be coupled to the escalator drive of the escalator by way of the controllable clutch transmission.

10. The escalator according to claim 1, wherein the platform is provided with a sidewall surrounding it on all sides, wherein the sidewall has a lockable access door on at least one side of the platform.

11. The escalator according to claim 1, wherein the platform is configured as a car floor, and, enclosing a car interior, is provided with car walls, a car roof, and at least one car door.

12. The escalator according to claim 1, wherein barriers are provided that separate a travel zone of the platform from the escalator.

13. The escalator according to claim 1, further comprising an access control system, which access control system comprises at least one console with a registration device for the registration of user data, and a blocking device, wherein depending on registered user data, access to the platform can be blocked or released by the blocking device.

14. A method for the modernisation of an existing escalator, the method comprising:

connecting the escalator to an elevator using fastening points arranged on a structural frame of the escalator for the fastening of components of the elevator, wherein the escalator comprises:

a first access zone arranged on a first level of a building;

a second access zone arranged on a second level of the building;

an inclined zone connecting the first and second access zones with one another; and the structural frame comprising the fastening points; and wherein components of elevator can be connected to the fastening points of the structural frame such that the components of the elevator can be supported, at least partially, by the structural frame, wherein the components of the elevator are arranged at a side of the escalator that is outside a conveyor zone of the escalator, at the fastening points of the structural frame, wherein the elevator is located between the same levels as the escalator and connects these with one another, and wherein the elevator comprises at least one guide rail and a platform that is moved in a guided manner on the guide rail.

15. The method of claim 14, wherein the elevator has a counterweight and a suspension device, which suspension device is connected at one end to the platform, and at the other end to the counterweight.

16. The method of claim 15, wherein the counterweight is arranged and can be moved in a guided manner in an interior space of the escalator bounded by covering panels.

17. The method of claim 16, wherein the elevator includes an elevator drive, which has a traction sheave and a drive motor, and over whose traction sheave the suspension device is guided, and the escalator includes an escalator drive, which is operatively connected to a circumferential movably arranged step chain of the escalator.

18. The method of claim 16, wherein the elevator comprises a traction sheave, over which the suspension device is guided, and a controllable clutch transmission, wherein the escalator includes an escalator drive, which is operatively connected to a circumferential movably arranged step chain of the escalator, and the traction sheave can be coupled to the escalator drive of the escalator by way of the controllable clutch transmission.

* * * * *